US005967496A

United States Patent [19]

Ulrich et al.

[11] Patent Number: 5,967,496

[45] Date of Patent: Oct. 19, 1999

[54] LIFTING DRUM HAVING A SELF-POSITIONING CABLE GUIDE

[75] Inventors: Alfred J. Ulrich, Alden; Casimer J. Koniniec, Depew; Gregory A. Gorecki, Eden, all of N.Y.

[73] Assignee: Reimann & Georger Corp., Buffalo, N.Y.

[21] Appl. No.: 09/093,470

[22] Filed: Jun. 8, 1998

[51] Int. Cl.[6] ..... B66O 1/36

[52] U.S. Cl. ..... 254/326; 254/327; 254/371; 254/336; 254/414; 254/390; 254/DIG. 14; 242/157 R; 242/397.5; 242/615.4

[58] Field of Search ..... 254/326, 327, 254/371, 380, 334, 335, 336, 414, 390, DIG. 14; 242/157 R, 615.2, 615.4, 397.5

[56] References Cited

U.S. PATENT DOCUMENTS

| | | | |
|---|---|---|---|
| 325,616 | 9/1885 | Lyons | 242/397.5 |
| 823,401 | 6/1906 | Ferris | 254/DIG. 14 X |
| 951,955 | 3/1910 | Lynch | 254/326 |
| 2,230,940 | 2/1941 | Ellsworth | 254/336 X |
| 2,344,417 | 3/1944 | Schmidt et al. | 254/327 X |
| 2,478,540 | 8/1949 | Martin | 242/397.5 X |
| 2,595,655 | 5/1952 | Hannay | 242/397.5 X |
| 2,860,006 | 11/1958 | Schonrock | 254/327 X |
| 3,309,066 | 3/1967 | Carlson et al. | 254/362 X |
| 3,319,936 | 5/1967 | Askins | 254/327 X |
| 3,515,297 | 6/1970 | Symons | 254/326 |
| 3,537,604 | 11/1970 | Whisler | 254/326 X |
| 3,836,123 | 9/1974 | Bausenbach et al. | 254/DIG. 14 X |
| 3,899,093 | 8/1975 | Allen | 254/327 X |
| 4,540,017 | 9/1985 | Prange | 242/397.5 X |
| 5,110,093 | 5/1992 | Rempinski et al. | 254/DIG. 14 X |

FOREIGN PATENT DOCUMENTS

| | | | |
|---|---|---|---|
| 1557761 | 1/1969 | France | 254/DIG. 14 |

*Primary Examiner*—Donald P. Walsh
*Assistant Examiner*—Emmanuel M. Marcelo
*Attorney, Agent, or Firm*—Wall Marjama Bilinski & Burr

[57] ABSTRACT

A cable guide for a winch having a lifting drum over which a cable is wound back and forth between two end flanges. A guide body in the form of a truncated cone is slidably mounted upon a pinion that is located adjacent to one end of the drum, generally perpendicular to the axis of the drum. The guide body contains a groove at its narrow end in which the cable rides as it approaches the end of the drum. The guide smoothly plays the cable onto the drum so that it can reverse its direction without producing multiple wraps at the end of the drum. A spring biases the guide body into a home position to accommodate the cable during the time the first wrap is being wound on the drum. Thereafter, the guide automatically moves back against the spring force to automatically align itself with regard to further wrapped layers.

7 Claims, 3 Drawing Sheets

LIFTING DRUM HAVING A SELF-POSITIONING CABLE GUIDE

BACKGROUND OF THE INVENTION

This invention relates broadly to a winching device for lifting a load and, in particular, to a cable guide for a winch, for guiding the cable smoothly onto the lifting drum of the winch.

A winch, as herein referred to, is a stationary device for lifting a load while a hoist, on the other hand, is a device that can be moved from place to place, as for example, on a wheeled trolley or the like. A winch typically includes a lifting drum about which a wire rope (cable) is wound to raise a load. The drum may be turned either manually or by a motor acting through a gear or sprocket and chain drive system. A racket and pawl mechanism is typically connected to the drive system to prevent the load from slipping as it is being raised. Larger winches are also equipped with brakes that operate to hold the load at a desired elevated position, thereby removing the load from the lifting system.

Most larger winches employ cable guides positioned at either end of the lifting drum to engage the cable as it reaches the end of a complete wrap and begins to reverse the direction of wrap back towards the opposite end of the drum. One such prevalent guide is an elongated metal cylinder that is located at each end of the drum. Each cylinder is mounted perpendicular to the axis of the drum and is arranged to contact the cable as it reaches the end of a wrap, taking some of the load from the cable and thus enhancing the cable's ability to reverse direction.

The lifting drum is generally equipped with radially expanded end flanges of ten times, the cable training over the cylindrical guide will wrap upon itself a number of times before it starts back in the opposite direction. As a result, when the wire rope finally reverses direction, it jumps down onto the last completed wrap, thus stressing or shocking the cable. When the load being lifted is high, the shock to the wire rope is correspondingly high and can, under certain conditions, shorten the life of the cable or cause damage to the lifting mechanism. Similarly, the cable only makes a single point contact with the cylindrical guide roller as it trains over the roller. This, coupled with the fact that the cable and the cylinder are in metal to metal contact, further acts to shorten the life of the cable.

Other guide systems have also been devised, such as follower systems of the type employed in high priced fishing reels, having a traveler that moves back and forth across the drum to continuously control the wrapping of the line in response to the rotational speed of the drum. Although these follower systems work well in practice, they are rather impractical for use in heavy duty winches because of the high line pulls involved and the expense involved in manufacturing and maintaining the device.

Simple ring systems are also known and used in the art, wherein a steel ring is welded to the end flange of the lifting drum and the cable allowed to run through the loop onto the drum. Although inexpensive, this type of system produces relatively high loads on the cable and again creates a single point running contact between the ring and the cable. Although this loop system is relatively simple and inexpensive, it is subject to early failure and produces less than satisfactory wrapping of the wire rope about the drum.

SUMMARY OF THE INVENTION

It is, therefore, a primary object of the present invention to improve winches and, in particular, winches for lifting relatively heavy loads.

It is a further object of the present invention to improve cable guides used in winches.

A still further object of the present invention is to improve the operation of winches and reduce the wear on the cable as it is being wound about the lifting drum of the winch.

Another object of the present invention is to reduce the potential for shocking a cable as it is being winched onto a lifting drum.

Yet another object of the present invention is to provide a self-adjusting cable guide capable of adapting to cables of different diameter.

These, and other objects of the present invention, are attained by means of a cable guide for use in a winch containing a lifting drum having a pair of radially extended end flanges. A cable guide having a body section in the form of a truncated cone is slidably and rotatably mounted upon a pinion adjacent to one end of the drum so that a cable being wound upon the drum tracks over the guide as it approaches the end of the drum. The narrow end of the guide, which faces the drum, forms a groove with an end disk in which the wire rope rides. The guide is biased into a home position by a spring so that the groove of the guide is vertically aligned with a given layer of wire rope that is wrapped about the drum. The guide automatically moves back on the shaft as the wraps on the drum increase to place the groove in an optimum position to guide the wire rope as it approaches the end of each wrap and initiate a new layer moving in the opposite direction. The guide prevents the cable from building up multiple layers at the end of the wrap so that the wire rope reverses direction smoothly without shocking the wire rope.

BRIEF DESCRIPTION OF THE DRAWINGS

For a better understanding of these and other objects of the present invention, reference will be made to the following detailed description of the invention, which is to be read in association with the accompanying drawings wherein.

DESCRIPTION OF THE INVENTION

Figure 1:
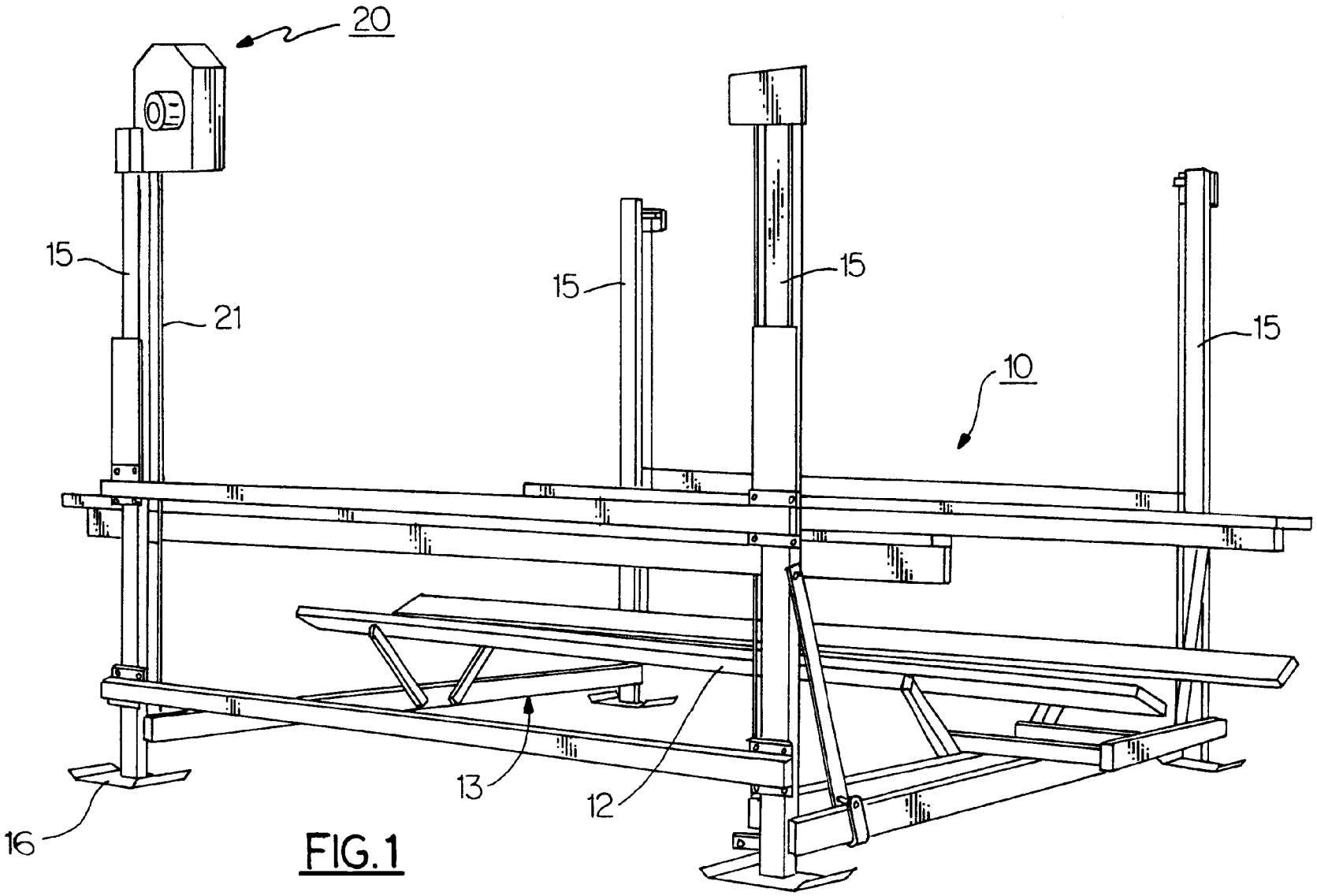
FIG. 1 is a perspective view of a boat hoist utilizing the teachings of the present invention.

Turning initially to FIG. 1, there is shown a repositionable hoist, generally referenced 10, for lifting a boat out of the water and supporting the craft at the elevated position above the water. The hoist assembly contains a saddle 12 upon which the keel of a boat can rest. The saddle, in turn, is attached to a lifting frame 13 that is slidably coupled to four vertical stanchions 15—15. Each stanchion contains a footing 16 that is arranged to rest upon the bottom of a body of water. The lifting frame is connected to a winch mechanism 20 housed on top of one of the stanchions by means of a cable 21. One end of the cable is anchored in the lifting drum 22 (FIGS. 2–4) of the winch and is arranged through means of a pulley system to raise the lifting frame as the cable is wound upon the drum. Such cable arrangements are well known in the art and need not be discussed herein in greater detail.

Although the cable guide of the present invention will be herein explained in association with a hoist for lifting a boat, it should become evident from the disclosure below that the present invention has further applications and is well suited for lifting different types of loads without departing from the teachings of the invention.

Figure 3:
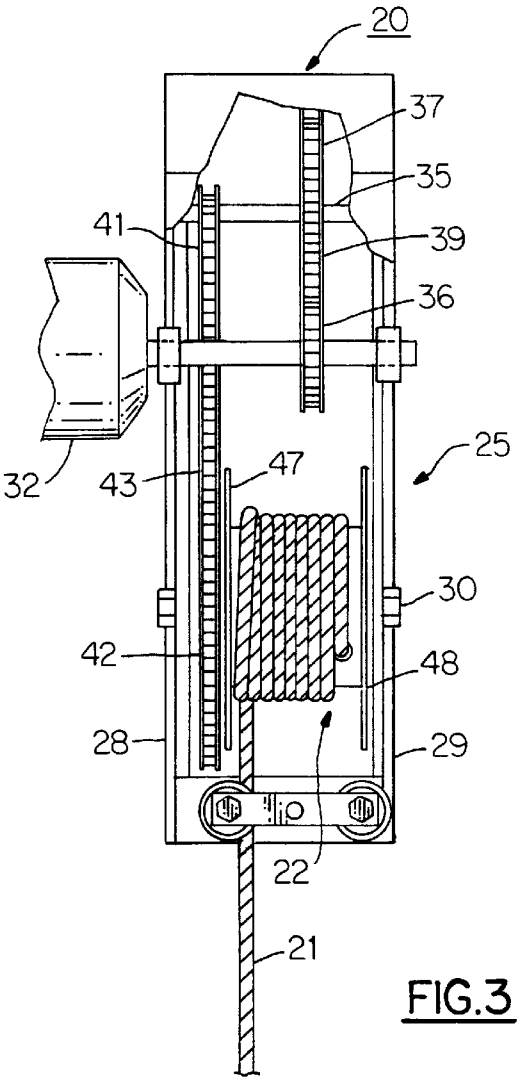
FIG. 3 is a sectional end view of the winching mechanism shown in FIG. 2.
Figure 2:
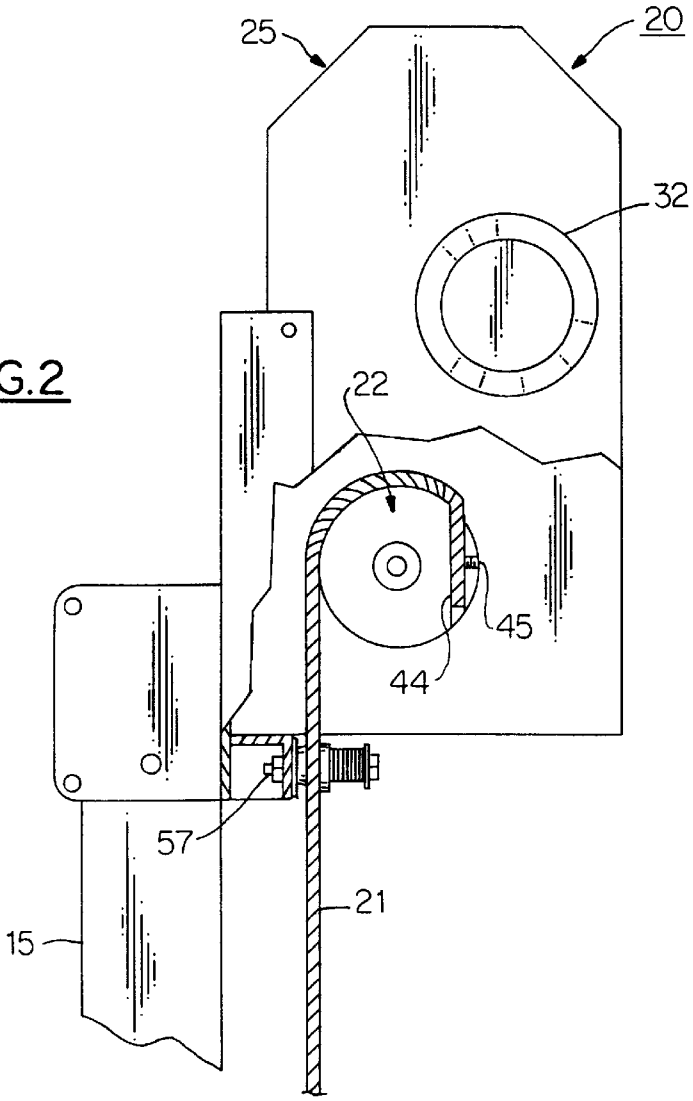
FIG. 2 is a partial side elevation with parts broken away showing the winch mechanism of the present invention.
Figure 4:
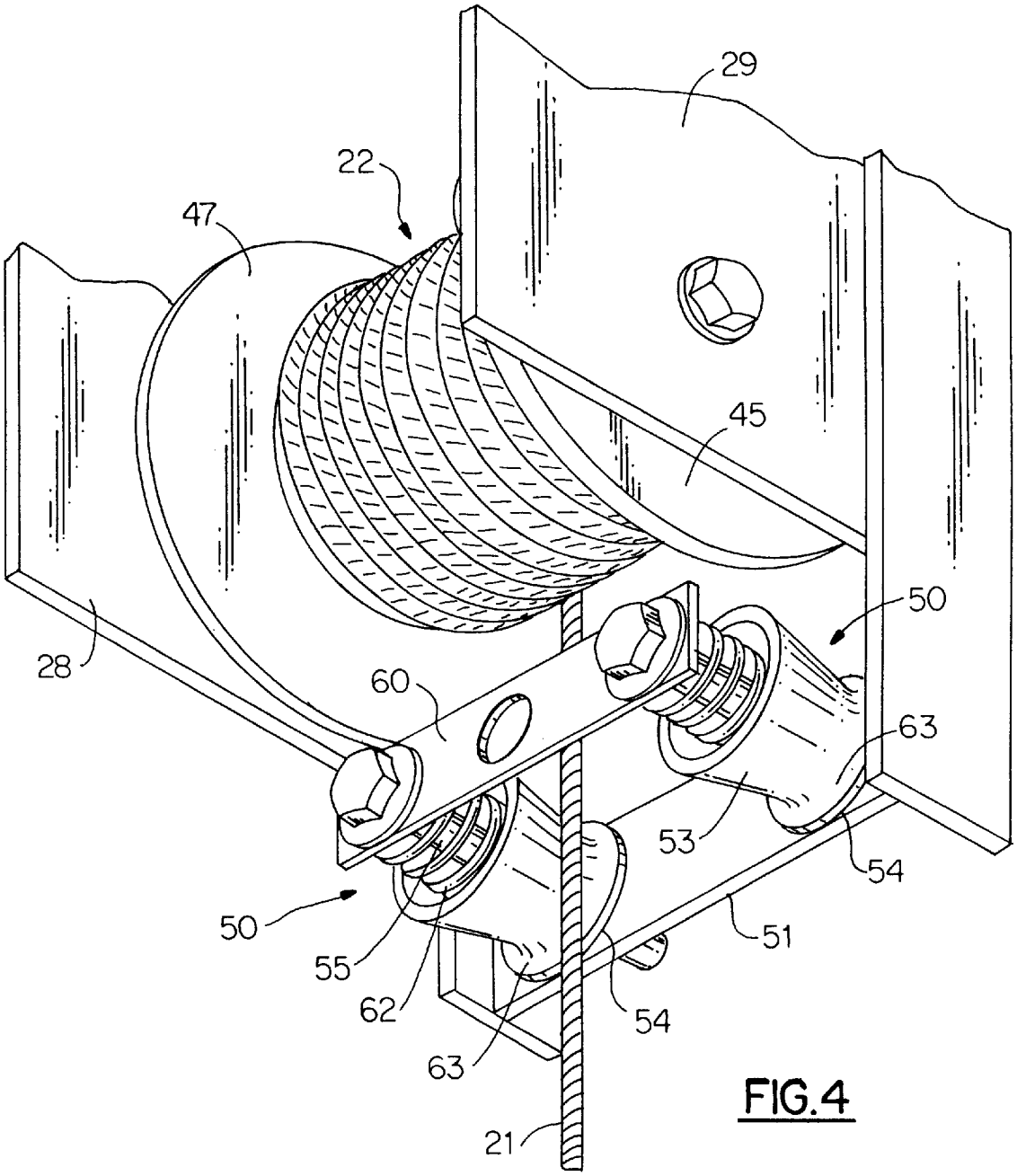
FIG. 4 is an enlarged perspective view showing the lifting drum and cable guides employed in the winching mechanism.

With further reference to FIGS. 2–4, the lifting winch is supported upon one of the hoist assembly stanchions 15 within a housing 25. The lifting drum 22 is rotatably mounted between side walls 28 and 29 of the housing upon a drum shaft 30. A motor 32 is secured to the housing by any suitable means (not shown), and the motor drive shaft journalled for rotation in the side walls of the housing. The drive shaft is connected to an idler shaft 35 by means of a drive sprocket 36 which is coupled to an idler sprocket 37 by an appropriate chain 39. The idler shaft, in turn, is coupled to the drum shaft by means of a second idler sprocket 41 which is connected to a drum drive sprocket 42 by chain 43. The drum drive sprocket is mounted upon the drum shaft 30 and is arranged to rotate the drum at a desired speed.

Although not shown, the drum shaft is also creatively connected to a ratchet mechanism which prevents the load from slipping as the lifting drum is being turned in one direction and a brake for holding the load at a desired elevated position. Both the ratchet mechanism and the brake are well known in the art and need not be discussed in further detail herein.

As best illustrated in FIG. 2, one end of the wire rope or cable 21 is passed into a hole 44 formed in the drum body and is secured to the body by means of a set screw 45. The cable receiving hole is located adjacent to one end of the drum as shown in FIG. 3.

The lifting drum is provided with a pair of radially expanded end flanges 47 and 48 that serve to prevent the wire rope or cable that is being wound upon the drum from passing over the ends thereof. As the drum is turned in one direction, the cable is wound in contiguous turns along the length of the drum. The turns are wound at a slight angle so that the cable "walks" from one end of the drum to the other to completely wrap the drum surface with a layer of cable. Upon reaching one end of the drum, the direction of wrap is reversed and another layer of cable is wound over the first.

As illustrated in FIG. 4, a pair of cable guides generally referenced 50 are mounted below the drum within a support bracket 51. Each cable guide is of similar construction and includes a truncated cone-shaped guide body 53 that is terminated at the narrower end by means of an enlarged end disk 54. The guide body is slidably contained upon a pinion 55 that is secured in the bracket by means of a suitable threaded fastener 57 (FIG. 2). The distal ends of the pinions are coupled together by a yoke 60, thus providing a rigid support for the pinions.

A spring 62 is coiled about each pinion which biases the companion guide body into a home position against the bracket 51. Each guide body further contains an arcuate shaped groove 63 that surrounds the narrow end of the body adjacent to the end disk. When in the home position, the groove of each guide body is vertically aligned with a given layer of cable wrapped about the drum. Accordingly, as the cable providing the first wrap approaches one end of the drum, the cable moves into contact with the guide body and is automatically directed into the groove. As noted above, each guide body is slidably mounted upon its supporting pinion and is able to adjust to the cable as it trains over the guide body. The guide body helps to guide the cable to the end of the drum and to start it back in the opposite direction before it can wrap upon itself a number of times against the drum end flange. When the cable reaches the end of the first layer, it will move over the last turn in the layer to start a second layer and reverse direction. At this time, the guide body will automatically move back upon the pinion to a new position to accommodate the second layer whereby the new layer will be smoothly initiated without shocking the cable. As noted above, multiple wrapping of the cable at the end of the drum can shock the cable when it eventually drops down from the multiple wraps and starts back in the opposite direction along the lower positioned, last wrapped layer. The shock force can be relatively high when the hoist is lifting a heavy load that can lead to early failure of the cable or potentially damage the winch mechanism.

As the number of wrapped cable layers increase, the guide bodies will be automatically pushed back along the support pinions against the biasing force of the associated springs due to the action of the cable as it trains over the guide body. The cable will rapidly find the groove in the guide body and, again be smoothly redirected in the opposite direction.

In practice, each of the guide bodies is formed of a high-strength plastic material. The groove formed in each guide body compliments the cable diameter and provides for an increased contact area between the cable and the guide body. Accordingly, wear on the cable is considerably reduced.

While this invention has been explained with reference to the structure disclosed herein, it is not confined to the details set forth and this invention is intended to cover any modifications and changes as may come within the scope of the following claims:

What is claimed is:

1. A winch for lifting a load that includes:

a lifting drum mounted for rotation about a horizontal axis, said drum further including a pair of radially disposed end flanges, a cable anchored at one end in said drum for lifting a load, said cable being arranged to wrap itself around the drum as the drum rotates to form layers of wound cable along the axial length of the drum between the end flanges, a cable guide mounted adjacent to at least one end flange for engaging the cable as it approaches said at least one end flange, said cable guide having a body formed in the shape of a truncated cone, said body having a narrow end and an enlarged end, a pinion mounted beneath the drum which is perpendicularly aligned with the axis of rotation of said drum, said cable guide slidably mounted upon said pinion with said narrow end of said body facing said drum, a disc mounted upon said pinion at the narrow end of said body section which cooperates with the body section to form a receiving groove for said cable at the narrow end of the guide body so that the cable rides in said groove as it is wound upon the drum, and a biasing means acting upon the cable guide for urging the guide toward a stop so that said groove in said guide body is drawn into alignment beneath a given layer of cable as the cable approaches said at least one end flange.

2. The winch of claim 1, wherein said biasing means is a spring that is wound about said pinion, said spring having a spring rate that allows the guide body to move along said pinion when the body is engaged by said cable as it is being wound upon said drum.

3. The winch of claim 2, wherein a cable guide is mounted adjacent to both ends of the drum.

4. The winch of claim 1, wherein said guide body is formed of a plastic material.

5. The winch of claim 1, wherein one end of the cable is received within a hole formed in said drum and is locked to the drum by a set screw.

6. A cable guide for use with a winch having a lifting drum mounted for rotation about a horizontal axis so that a cable track back and forth axially between a pair of radially disposed end flanges as the cable is wound upon the drum, said cable guide including, a pinion mounted beneath said drum that is perpendicularly aligned with the horizontal axis of said drum, said pinion being mounted adjacent to one end flange of said drum, a guide member axially slidably retained upon the pinion, said guide member includes a truncated cone-shaped body section having a small diameter end facing the drum and a radially expanded disc adjacent the small diameter end of the body section that forms a groove with said body section in which a cable being wound upon the drum is received as it approaches the said one end flange.

7. The cable guide of claim 6 that further includes a spring means that is wound about said pinion to urge the guide member toward a stop position.

* * * * *